United States Patent [19]

Greer et al.

[11] 4,187,626

[45] Feb. 12, 1980

[54] EXCAVATING TOOL HAVING HARD-FACING ELEMENTS

[75] Inventors: Donald J. Greer, Danville, Ill.; John D. MacEwan, Jr., Portland, Oreg.

[73] Assignee: ESCO Corporation, Portland, Oreg.

[21] Appl. No.: 881,724

[22] Filed: Feb. 27, 1978

[51] Int. Cl.[2] ..... E02F 9/28

[52] U.S. Cl. ..... 37/141 R; 37/142 R; 172/719

[58] Field of Search ..... 37/141 R, 141 A, 142 R, 37/142 A, 115–118; 172/719, 767, 772; 299/79, 88, 91, 36

[56] References Cited

U.S. PATENT DOCUMENTS

| | | | |
|---|---|---|---|
| 1,333,394 | 3/1920 | Ekman | 37/142 R |
| 1,835,701 | 12/1931 | Edmunds | 37/142 R |
| 2,608,111 | 8/1952 | Ratkowski | 37/142 R |
| 3,286,379 | 11/1966 | Benetti | 37/142 A |
| 3,529,677 | 9/1970 | Stephenson | 172/767 |
| 3,805,423 | 4/1974 | Engel et al. | 37/142 R |
| 4,083,605 | 4/1978 | College et al. | 37/142 R X |

*Primary Examiner*—E. H. Eickholt

*Attorney, Agent, or Firm*—Tilton, Fallon, Lungmus & Chestnut

[57] ABSTRACT

An excavating tool having hard-faced elements supported in the material engaging surface thereof, the elements having generally planar faces disposed at an angle to the ground engaging surface.

4 Claims, 31 Drawing Figures

EXCAVATING TOOL HAVING HARD-FACING ELEMENTS

BACKGROUND AND SUMMARY OF INVENTION

This invention relates to an excavating tool having hard facing elements supported in a material-engaging surface thereof and, more particularly, to tools such as excavating teeth, excavating blades, or cutting edges such as those employed on underground mining plows.

Since about the turn of the century workers in the excavating art have employed replaceable earth engaging elements such as two-piece teeth, i.e., the wedge shaped projections on the penetrating edge of a scraper, dipper, bucket, etc. This has also been true of blades and cutting edges and has permitted renewal of the penetrating portion (after the same had become worn) with a minimum of throw-away metal. In some cases in especially abrasive digging, it is not unusual for the tool to be replaced every eight hours.

The need for point replacement (because of wear) was disadvantageous not only because of the cost of the element itself but because of the loss of use of an expensive machine, i.e., down time. Efforts have been made throughout the years to minimize down time by providing temporary locks which were effective to keep the point or other tool in place during operation but which could be readily deactivated to permit quick replacement. Nonetheless, some time was still required for the disassembly of the tool and replacement of the principal material engaging part.

This led the art workers to consider "hard-facing" the excavating teeth, blades, etc. The usual material considered for this purpose was tungsten carbide which had been used for facing machine tools and drill bits. An early attempt in the excavating tooth field is seen in the 1936 patent of Stoody U.S. Pat. No. 2,033,594. There particles of tungsten carbide were placed within the apex groove of the tooth.

A more recent attempt in this field is represented by Jackson et al U.S. Pat. No. 3,790,353 which made use of a wear pad of 70–85% of particles of cemented tungsten carbide and wherein the pad was attached to the upper forward surface of the tooth point. In Engel, et al U.S. Pat. No. 3,805,423, a large insert of tungsten carbide was placed in a recess in the point upper surface. In Baum, U.S. Pat. No. 4,024,902, sintered tungsten carbide particles were dispersed within the steel alloy making up the tooth point. None of these expedients have proved successful. Tooth points equipped with hard facing elements have not worked out primarily because the elements have been gouged or flaked out because of the substantial impacts which occur during excavating.

We have discovered that the life of an excavating tool (such as an excavating tooth point or blade) can be materially increased if the hard-facing elements (generically referred to as "carbides") are supported at an angle to the material engaging surface in which they are positioned, the angle being generally perpendicular to the average force line of the material being engaged by the tool. This results in substantial avoidance of gouging, flaking, cracking, etc. with the result that the life of the tool now approaches that of the hard-facing elements rather than the much shorter life of the supporting alloy steel. Other details, advantages and objects of the invention may be seen as this specification proceeds.

DETAILED DESCRIPTION

The invention is described in conjunction with the accompanying drawings, in which FIG. 1 is a fragmentary schematic side elevational view of a shovel dipper bucket in the process of excavating and which is employed to explain certain facets of the invention;

Figure 1:
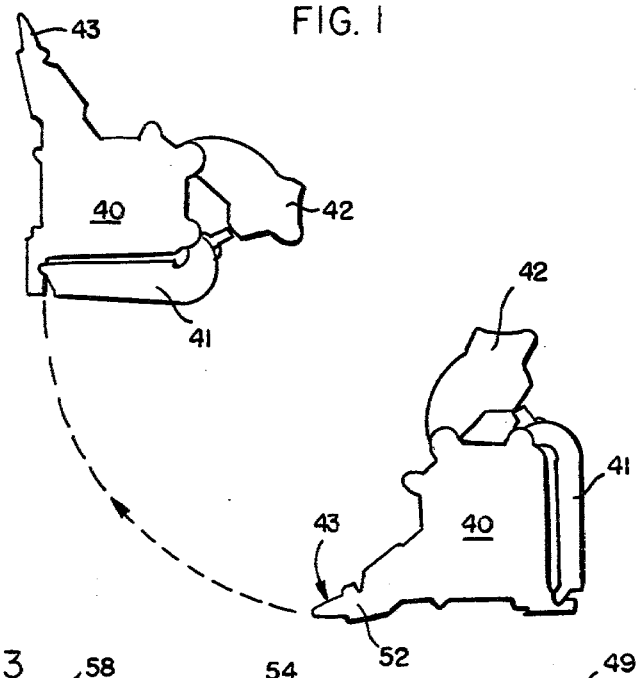
Figure 8:
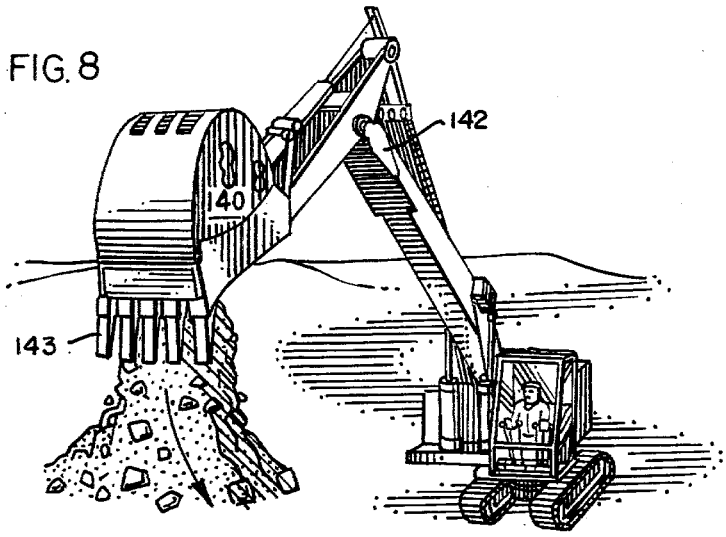
FIG. 8 is a fragmentary perspective view of a back hoe equipped with teeth featuring the instant invention.

Referring first to FIG. 1, the numeral 40 designates a shovel dipper bucket which is equipped with the usual drop open door 41 and is carried by the usual dipper stick 42. The numeral 43 designates generally the wedge shaped excavating teeth spaced across the digging edge of the dipper 40. The shovel dipper normally moves through an arc (represented in dotted line) for removal of earth or other material from a selected site. The shovel dipper differs, for example, from the hoe dipper seen in FIG. 8. There the hoe dipper bucket is designated by the numeral 140 and is equipped with a plurality of forwardly projecting teeth 143, the bucket 140 being carried on the back hoe boom and stick 142. The back hoe dipper bucket 140 excavates material by moving downwardly and inwardly, as contrasted to the upward arc depicted in FIG. 1.

Figure 9:
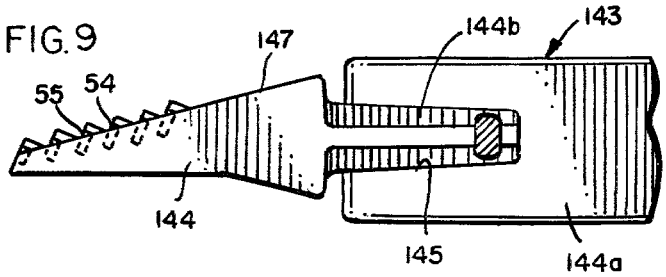
FIG. 9 is an enlarged longitudinal sectional view of one of the excavating teeth of the apparatus of FIG. 8.

The teeth 43 or 143 normally consist of two parts, a point 144 and an adapter 144*a* (see FIG. 9). The adapter 144*a* is the element which is secured to the dipper or other excavating device and to which the point is pinned or otherwise locked. In the illustration given in FIG. 9, the point 144 is equipped with a shank 144*b* which is received within a socket 145 for mounting the point. In the illustration given in FIGS. 2–4, the point 44 is equipped with a socket 45 which provides the means for mounting the point. Exemplary of the types of points and adapters useful in connection with the instant invention are those seen in U.S. Pat. No. 2,919,506.

Figure 2:
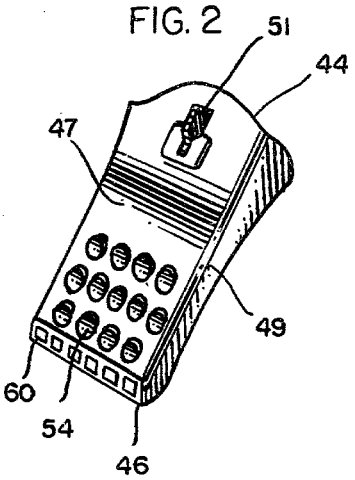
FIG. 2 is a perspective view of an excavating tooth point such as would be mounted on the bucket of FIG. 1.
Figure 3:
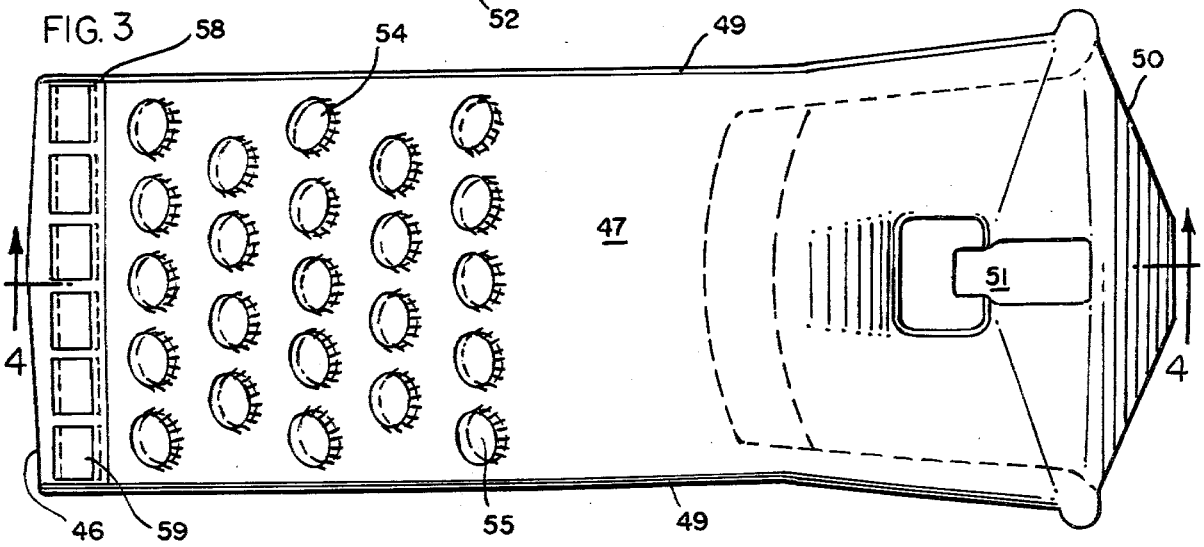
FIG. 3 is a top plan view of the point of FIG. 2.
Figure 4:
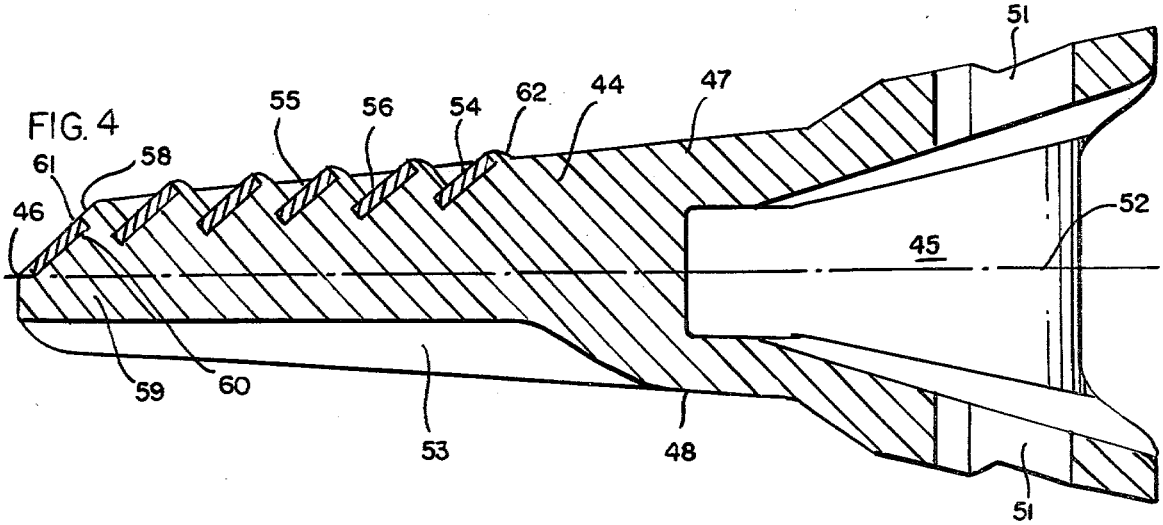
FIG. 4 is a sectional view taken along the line 4—4 of FIG. 3.

A consideration of FIGS. 2–4 reveals that the point 44 is essentially wedge shaped in proceeding rearwardly from the material engaging or penetrating edge 46. Wedge surfaces 47 and 48 (the latter being designated only in FIG. 4) are provided on what are nominally the top and bottom of the point 44. These are flanked by side surfaces 49 and the four surfaces together adjacent the mounting end 50 (see FIG. 3) provide enough of a box-shape to permit the development of the socket 45. The surfaces 47 and 48 are interrupted as at 51 for the receipt of a locking pin which temporarily secures the point to its associated adapter (not shown). For the purpose of mounting the point 44 on the adapter, the point 44 is normally moved rearwardly in a direction parallel to its mid plane 52 (see FIG. 4) to receive a nose (not shown) generally conformable to the socket 45.

Normally, one of the wedge surfaces 47 and 48 is the principal surface for engagement of material being excavated. The surface not so frequently engageable with the earth or other material being penetrated very often will be equipped with a notch or recess as at 53 (see FIG. 4) to reduce the amount of metal in the penetrating section. In any event, we are concerned with the more frequently engaged surface 47 because this is the surface that normally is subjected to the greatest wear.

According to the invention, we equip the surface 47 (or 147 in the case of a back hoe) with a plurality of wear resistant elements 54. In the illustration given in FIGS. 2–4, the elements 54 are seen to be disc-like, i.e., relatively flat cylinders. Each element 54 has a generally planar top or outwardly directed face 55. The thickness of the element 54 (measured perpendicularly to the planar face 55) is substantially the same throughout the element 54.

The elements 54 are mounted in the surface 47 (more particularly the portion of the point member 44 defining the surface 47). For this purpose, we provide a recess 56 in the surface 47 which carries an element 54. The points 44 are preferably made by casting and in such a case, the already prepared elements 54 are disposed suitably within the mold cavity to provide the configuration of FIG. 4, for example. These principles may also be used in other means of fabrication such as brazing onto a plate in a "grater" configuration, viz., having the appearance of a vegetable grater.

Each of the elements 54 is advantageously constructed of a wear resistant material substantially harder than the material of construction of the body of the point 44. Normally the point 44 is constructed of alloy steel while the wear resistant elements 54 are constructed of tungsten or other cation carbides or other like anions suitably disposed or cemented within a matrix of cobalt or the like. A wide variety of hard facing materials are available to the art and the instant invention is not concerned with the composition of these materials but rather the arrangement of the material with respect to the excavating tool, hence the use of the colloquial "carbides".

Figure 5:
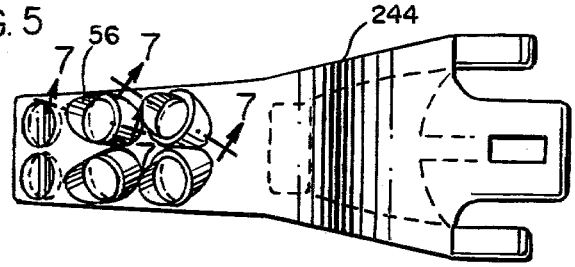
FIG. 5 is a top plan view of a tooth point suitable for mounting on a dredge.
Figure 6:
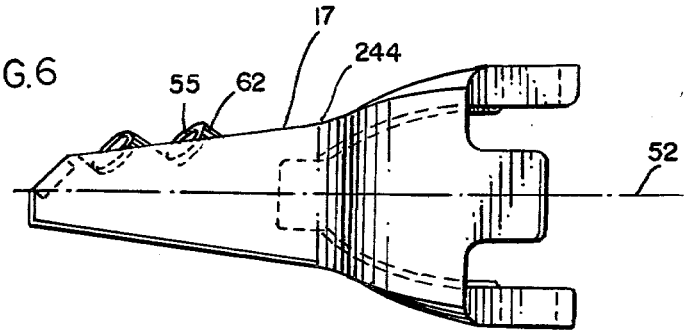
FIG. 6 is a side elevational view of the point of FIG. 5.
Figure 7:
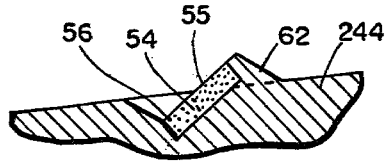
FIG. 7 is an enlarged fragmentary sectional view such as would be seen along the sight lines 7—7 of FIG. 5.

In general, we have discovered that the element 54 (as exemplified by the top face 55 thereof) should be disposed at an angle of from about 30° to about 75° with respect to the mid-plane 52. Inasmuch as the surface 47 is at a much more acute angle with respect to the mid-plane, this necessarily results in the faces 55 being angularly related to the material engaging surface 47. We have found, for example, that where the point 44 is part of a dipper tooth, viz., the shovel dipper 40, the advantageous orientation is about 40°. On the other hand, extremes in excavating machine design or mode of operation of the element may lead to angle faces 55 advantageously of the order of 75°. The point 244 illustrated in FIGS. 5–7 is particularly suited for use on a dredge cutterhead and greater details on such a machine can be seen in co-owned application of Decombe et al Ser. No. 749,291 filed Dec. 10, 1976, now Pat. No. 4,080,708. In the case of a dredge cutterhead, optimal orientation of the face 55 of the element 54 with respect to the mid-plane 52 is of the order of 40°–45°.

Figure 10:
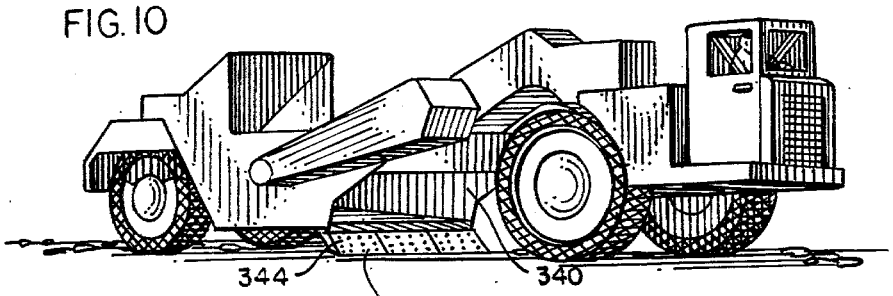
FIG. 10 is a perspective view of a scraper equipped with blades constructed according to the teachings of this invention.

Turning now to FIG. 10, the numeral 340 designates a scraper drop bucket equipped with a plurality of plate shaped excavating blades 344 across the leading edge thereof. The scraper moves forward in a generally straight line, lowering its bucket 340 into the earth or material beneath it, using the blades 344 to deflect the material into the bucket for reclamation.

The blades 344 may each consist of one piece, bolted to the body of the scraper for easy replacement, or of two peices, the front piece being replaceable as in U.S. Pat. No. 3,685,177. Also, optional teeth may be installed to work in conjunction with the blades by protruding forward from them and assisting them in penetration of the material being excavated.

Figure 11:
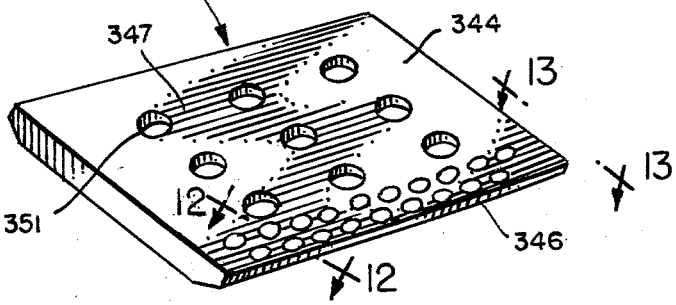
FIG. 11 is an enlarged perspective view of one of the blades of FIG. 10.
Figure 12:
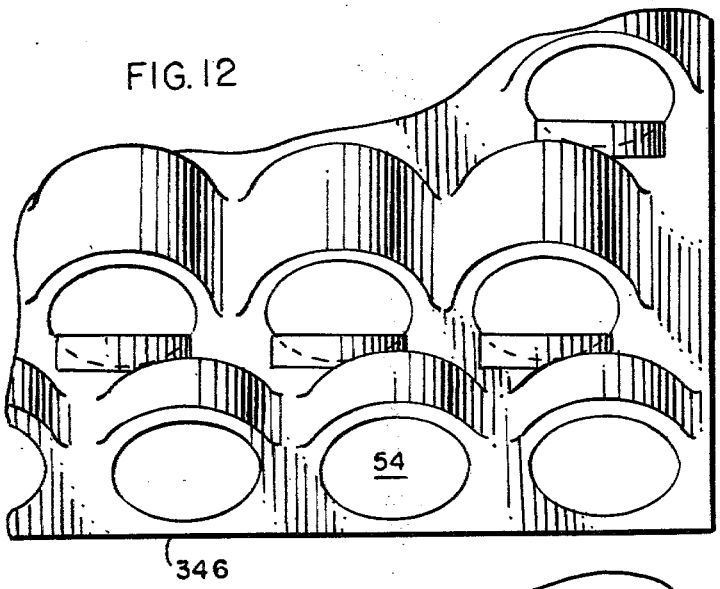
FIG. 12 is a view such as would be seen from the line 12—12 of FIG. 11.
Figure 14:
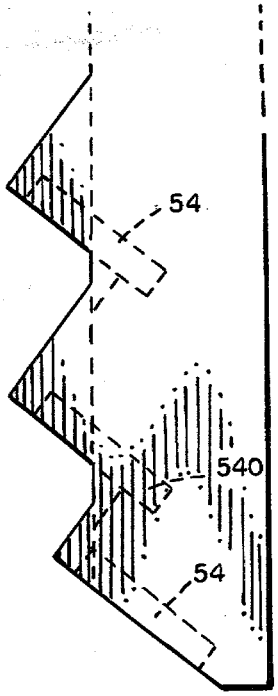
FIG. 14 is a fragmentary end view such as would be seen from the line 14—14 of FIG. 13.
Figure 13:
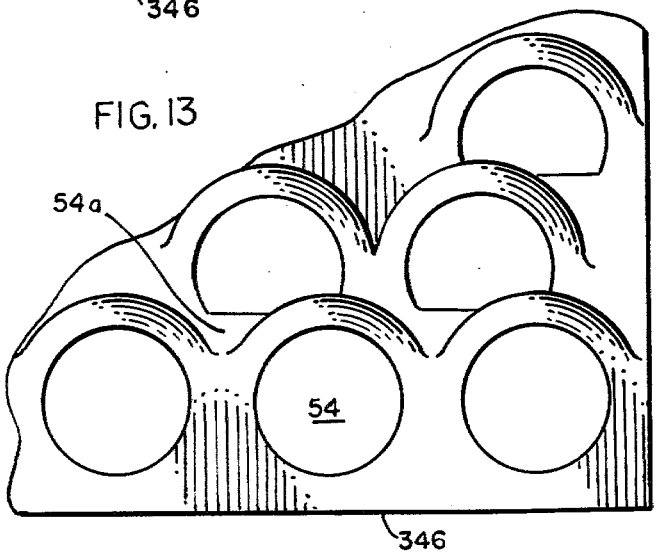
FIG. 13 is a view such as would be seen from the line 13—13 of FIG. 11.

A consideration of FIG. 11 reveals that the blade is generally planar in shape, with a thickness small in relation to its linear dimensions. Normally the forward face 347 is the principal surface for engagement with the material being excavated. The structure to which the blade is bolted (through bolt openings 351) is found behind the blades and the blade can be of varying thickness to place extra metal at the locations of high wear. To apply the principles of this invention to this type of excavating tool, we equip the surface 347 with a plurality of wear resistant elements 54 particularly at the region of the surface 347 closest to the leading edge 346 of the blade. A consideration of FIGS. 12–14 reveals one preferred form of arraying the elements 54 along the leading edge 346. In particular, the forward portion of each element 54 is partially immersed—see also FIG. 4 and compare with FIG. 7.

Figure 15:
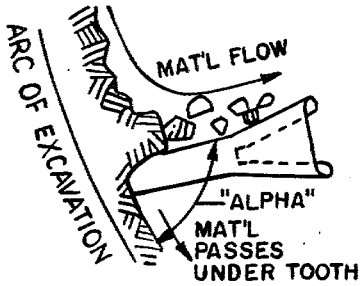
FIGS. 15 and 16 are fragmentary schematic views showing how a tooth and a blade penetrate material being engaged.
Figure 16:
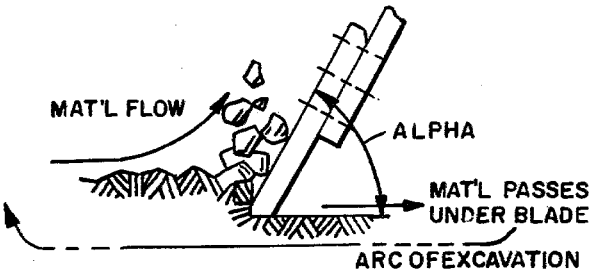

The selection of the precise angle of the face 55 with the surface 47 is a function of the material, the machine, and the mode of excavation. More particularly, it is advantageous to position the confronting face 55 of the element 54 generally perpendicular to the average force line of the material being engaged. An earth-engaging tooth or blade generally moves through a segment of an arc during excavation of material, with the tooth or blade partially or totally immersed in the material in situ and its excavating face at an angle "Alpha" (found to be optimum by experience) relative to the material, as depicted in FIGS. 15 and 16.

The effect of this movement is to displace the upper layers of the material over the excavating face of the tooth or blade and into the shovel bucket (or similar excavating device) for reclaiming, while lower layers of the material remain in situ for further excavation. This effect and angle "Alpha" are shown particularly in FIGS. 15 and 16.

Figure 17:
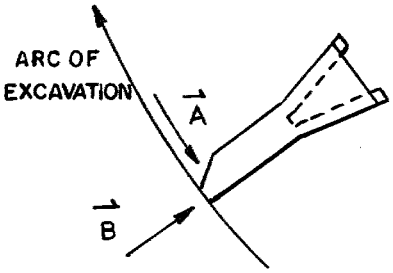
FIGS. 17 and 18 are additional fragmentary schematic views (similar to FIGS. 15 and 16) and illustrating certain force vectors, the understanding of which is believed helpful in appreciating the operation of the invention.
Figure 18:
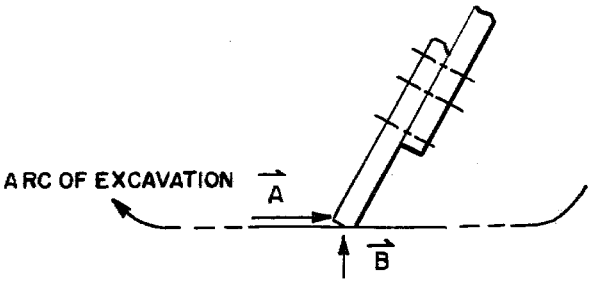

This movement of the tooth or blade is resisted by the material, not only in the direction of movement along the arc of motion or excavation, but also in a direction perpendicular to that arc. This effect may be visualized by two force vectors: Force "A" being tangential to the arc of excavation and resisting the movement of the tooth; and Force "B" being normal to the arc and by itself actually tending to displace the tooth or blade out of the material being excavated (see FIGS. 17 and 18).

The presence of these two forces has been observed by experience and also in physical experimentation. The magnitude and direction of forces acting on a tooth or blade may vary considerably from moment to moment, but the components of those forces may always be resolved into forces in the coordinate system of "A" and "B" shown.

Figure 19:
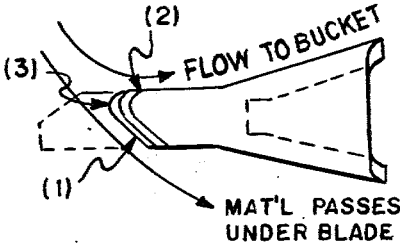
FIGS. 19 and 20 are still further fragmentary schematic views explaining the operation of the invention in terms of the regions of the tool being contacted.
Figure 20:
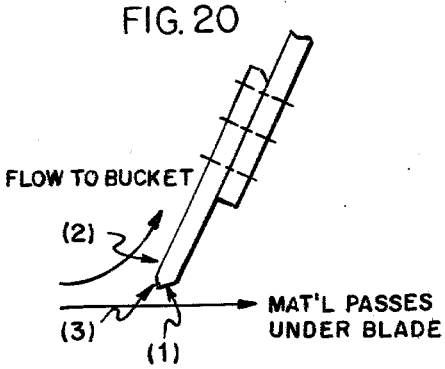

It is the material being excavated which exerts these forces, by virtue of physical contact with the various portions of the tooth or blade—see FIGS. 19 and 20.

In region (1), the material which passes underneath the tooth or blade contacts it in a sliding or abrading manner, flowing in the direction shown.

In region (2), the material strikes the tooth or blade at somewhat of an angle to its excavating face and is diverted into the shovel bucket or similar device.

In region (3), the material strikes the front corner directly and is diverted to pass either underneath the tooth or blade or over it, making for a rounded transition zone between regions (1) and (2). This contact or impingement of material upon the tooth or blade causes physical removal of metal from it and makes replacement necessary after a period of time.

Figure 21:
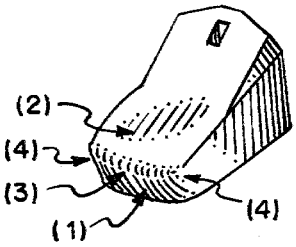
FIGS. 21 and 22 are additional fragmentary schematic views showing wear patterns evolving from the contact regions described in conjunction with FIGS. 19 and 20, respectively.
Figure 22:
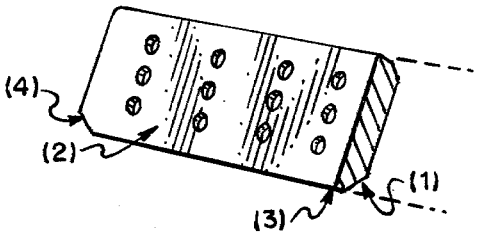

A sketch of a typical worn tooth and blade are shown in FIGS. 21 and 22. Region (1) generally appears as a cross-sectional plane at an angle across the tooth or blade; region (2) generally consists of a plane more-or-less parallel to the original surface; region (3) will be more-or-less rounded off; as any sharp corners here are particularly subject ot metal removal or "wear"; and the corners, region (4), will also be rounded off, to a greater degree than the central portions of the tooth or blade. An extension of the duration of service or "wear-life" of a tooth or blade is beneficial and results in greater economy of operation.

Figure 23:
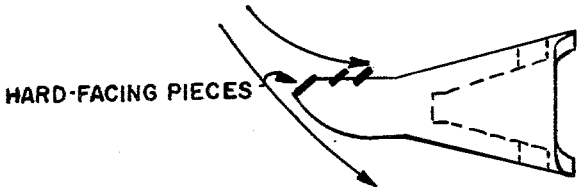
FIGS. 23 and 24 are schematic depictions of a tooth and blade respectively showing the preferred locations of hard facing elements.
Figure 24:
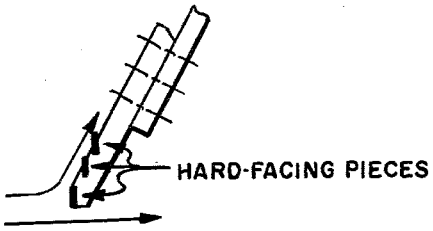
Figure 25:
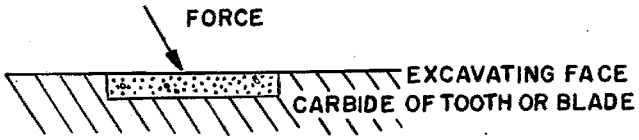
FIG. 25 is a fragmentary schematic view of a flush mounted hard-facing insert.

It is seen in FIGS. 23 and 24 that by the placement of a wear-resisting, more durable "hard-facing" piece or region across the location indicated in the leading edge of the excavating face of the tooth or blade, would extend the wearlife of the tooth or blade, not only by its own reduced rate of metal removal, but also by the protection from abrasion it affords to the parent metal behind and below it. This explanation details the theory of our invention for the placement of such pieces, viz., the carbides. If a carbide piece were to be placed flush with the excavating face of the tooth or blade (see FIG. 25), it would be exposed to the impinging forces of oncoming material (that is, the combined effects of Force "A" and Force "B") at an angle not essentially perpendicular to its own face.

Figure 26:
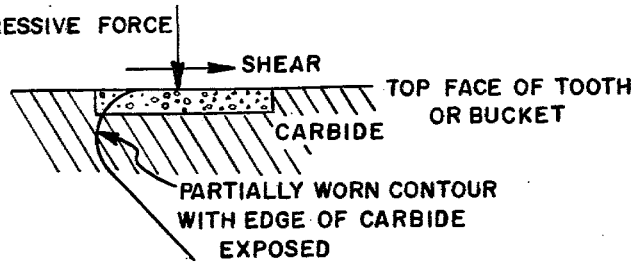
FIG. 26 is a fragmentary schematic view (like FIG. 25) and showing the resolution of forces applied to the hard facing insert.

As seen in FIG. 26, the impinging forces of oncoming material may be resolved into components "normal" and "parallel" to the face of the carbide. This resolution of forces is seen to be equivalent to a "compressive" force and a "shear" force. This "shear" force is particularly destructive to the carbide, and even more so if the leading corner or edge of the carbide is exposed, as is the case with a partially worn tooth or blade. The shear force physically removes material from the exposed surfaces of the carbide at a detrimental rate, not only by surface abrasion but also by whole gouging and flaking. Without exception sofar as we can determine, previously the confronting face of a wear resistant element has been flush with or parallel to the more frequently assulted material engaging surface. This has resulted in the objectionable gouging of the wear resistant elements and even total loss thereof because of the peculiar stresses applied to the edges of the elements where they were supposedly bonded to the main body of the supporting tool member. Whereas a carbide is very much stronger in compression than in either shear or tension, it would be advantageous to reduce or eliminate any shear forces acting on the exposed carbide surface, in order to increase its service life and that of the tooth itself. Since the face angle "Alpha" must remain essentially unchanged for optimum excavation, and with the orientation of the resistive forces to excavation therefore also unchanged, our invention is to place the carbides at an angle relative to the top face of the tooth. Placing the carbide essentially perpendicular to the resistive forces of excavation and the flows of material, has two interrelated beneficial effects:

(a) This places much of the carbide in compression and reduces much of the shear forces which contribute to its destruction;

(b) This exposes a maximum surface area of the carbide perpendicular to the flow of oncoming material, affording a maximum of protection to the parent metal of the tooth behind the carbide.

Figure 27:
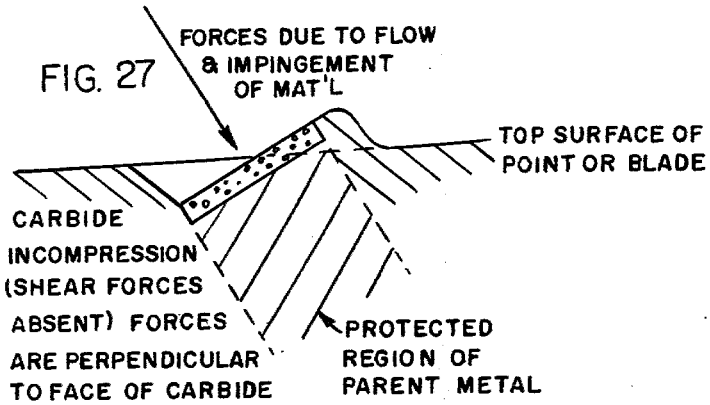
FIG. 27 is a fragmentary sectional view showing a preferred form of mounting the hard facing insert element with FIG. 28 showing the same, but partially worn.
Figure 28:
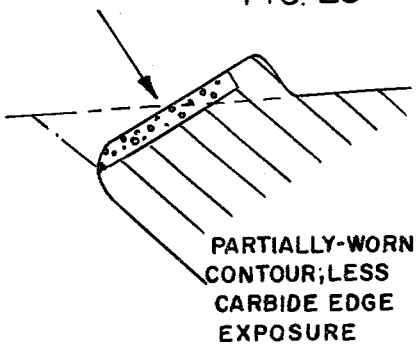

As seen in FIGS. 27 and 28, the carbide is placed partially above and partially below the basic surface of the tooth for the following regions:

(a) To recess the carbide entirely below the point surface would unduly weaken the point, if the point were thickened to compensate for this, its weight and difficulty of penetration would be detrimentally increased.

(b) To support the carbide entirely above the surface of the point would place it in an exposed position relative to the excavated material flowing up the top face of the tooth toward the bucket, particularly so with carbides nearer to the bucket end of the tooth, which are exposed to wear for a relatively longer period of time.

(c) It is desired to have the face of the tooth be as smooth as possible, so as not to impede the flow of material up the tooth, and also to reduce the ability of certain sticky materials to cling to the tooth face. Either extreme in location above or below would provide a rougher surface.

Figure 29:
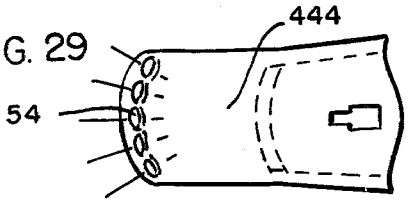
FIG. 29 is a top plan view of a point featuring a carbide arrangement according to the invention.

The carbides on either side of centerline in the top plan view may be turned outward, see FIGS. 3, 5 and 29. This, again, is done to place the carbide elements 54 with maximum surface area perpendicular to the forces of excavation and to resist metal removal by abrasion, which is accelerated on the side front corners of the point 444. It places them normally to the way the tooth wears back, which is usually more extreme at the corners.

Still referring to FIG. 3, there is provided an additional surface 58 which extends between the heretofore referred to "top" surface 47 and the penetrating edge 46. The surface 58 is optimally arranged at the same angle with respect to the midplane 52 as are the confronting faces 55 of the elements 54, viz., in the example given in FIGS. 1–4, approximately 40°. The elements 59 provided as part of the surface 58 are mounted in conforming recesses 60 (developed by casting) and the confronting face 61 of each element 59 is flush with the additional surface 58. It will be seen from a consideration of FIGS. 2 and 3 that the elements 59 are rectangular in plan as contrasted to the circular plan of the elements 54. In some instances, it may be advantageous in the casting operation to utilize all cylindrical elements so as to get uniform bonding of the alloy steel making up the major portion of the point body 44. It is not necessary that the carbides be of uniform thickness. Nor must all carbides in a tooth have the same thickness. They are generally prismatic rather than parallelpiped, but this is not mandatory.

The wear resistant elements 54 are advantageously constructed of metalic carbides such as conventional tool steel carbides containing 89% tungsten carbide disposed within a cobalt matrix. However, the invention finds advantageous application to the use of other cemented or sintered carbide or like anion articles and wherein the cation may be varied to include molybdemun, chromium, vanadium, etc.

Figure 30:
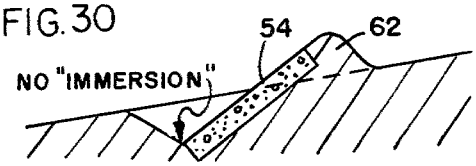
FIGS. 30 and 31 are further fragmentary schematic views explaining features of the invention.
Figure 31:
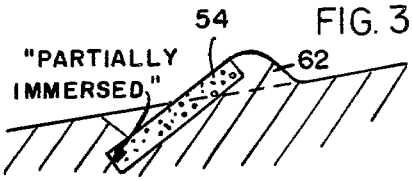

Referring now to the showing in FIGS. 5–7, this illustrates one fashion on how the inserts or elements 44 are supported in the point 244. More particularly, the elements 44 are provided with a surrounding shoulder as at 62 in order to surround the carbide in parent metal: by the effects of physical metallurgy and differential cooling rates of parent metal and carbides used, this places the carbide in residual compression by "hoop stresses". This increases the total strength of the carbided tooth. It is also done for ease of placement in the mold and for metallurgical heat transfer. The carbide may or may not be partially immersed, as shown in FIGS. 30 and 31.

Immersion into the parent metal as at 63 is done for mainly mechanical reasons, such as for minimizing the reduction in cross-sectional area and strength of the parent part, for maximizing surface smoothness in regions containing adjacent carbides, or for providing increased "flow" of molten parent metal in the region of the carbides during "pouring" of the parent metal into the mold. The effect is generally beneficial and gives greater flexibility, but is not mandatory.

While in the foregoing specification we have set down detailed descriptions of a number of embodiments of the invention for the purpose of explanation of the invention, it will be appreciated that amny variations may be made within the details given without departing from the spirit and scope of the invention.

We claim:

1. In a tool for excavating, a unitary metal member having a material engaging edge at one end and a mounting means spaced from said one end, said member having a generally planar material engaging surface extending generally from said one end, and a plurality of wear resistant elements mounted in said surface, the improvement characterized by the fact that each element has a generally planar outer face disposed at an angle to said surface, the outer face of each wear element being intersected by the plane of said surface, each element being of a uniform thickness in the direction measured perpendicular to said face, said face being generally perpendicular to the average line of force of material being engaged by said tool, said tool being equipped with an integral shoulder upstanding from said surface for each element.

2. In a tool for excavating, a unitary metal member having a material engaging edge at one end and a mounting means spaced from said one end, said member having a generally planar material engaging surface extending generally from said one end, and a plurality of wear resistant elements mounted in said surface, the improvement characterized by the fact that each element has a generally planar outer face disposed at an angle to said surface, said tool surface having side edges extending perpendicularly away from said engaging edge, the faces of elements adjacent one side edge being inclined toward said one side edge, the faces of elements adjacent the other side edge being inclined toward said other side edge.

3. In a tool for excavating, a unitary metal member having a material engaging edge at one end and a mounting means spaced from said one end, said member having a generally planar material engaging surface extending generally from said one end, and a plurality of wear resistant elements mounted in said surface, the improvement characterized by the fact that each element has a generally planar outer face disposed at an angle to said surface, said tool being equipped with an additional generally planar, material-engaging surface extending between said engaging edge and the first mentioned surface, said additional surface being inclined to said first mentioned surface at about the same angle as said element faces, said additional surface having a plurality of depressions therein, a wear-resistant element in each of said depressions, each of said additional surface elements having an outer surface disposed generally flush with said additional surface.

4. A point for an excavating tooth comprising a generally wedge-shaped metal member having a material engaging edge at one end and a mounting means at the other end, said member having a pair of generally planar surfaces diverging from said edge to define a wedge shape, a plurality of wear-resistant elements in one of said surfaces, each element having a generally planar face and a uniform thickness measured perpendicular to said face, said faces being intersected by the plane of said one surface, said faces being inclined rearwardly relative to said one surface and at an angle of about 30° to about 75° relative to the mid-plane between said wedge surfaces.

* * * * *